US005601458A

United States Patent [19]

Ohsumi et al.

[11] Patent Number: 5,601,458

[45] Date of Patent: Feb. 11, 1997

[54] ELECTRIC TERMINAL

[75] Inventors: Hideki Ohsumi; Seiji Kozono; Michio Akashi, all of Shizuoka, Japan

[73] Assignee: Yazaki Corporation, Tokyo, Japan

[21] Appl. No.: 298,675

[22] Filed: Aug. 31, 1994

[30] Foreign Application Priority Data

Aug. 31, 1993 [JP] Japan ..... 5-216040

[51] Int. Cl.[6] ..... H01R 11/22

[52] U.S. Cl. ..... 439/852; 439/851

[58] Field of Search ..... 439/851–856, 439/861, 862, 886, 842, 843

[56] References Cited

U.S. PATENT DOCUMENTS

| | | | |
|---|---|---|---|
| 4,306,761 | 12/1981 | Ress, Jr. | 439/862 |
| 4,540,233 | 9/1985 | Saijo et al. . | |
| 4,560,231 | 12/1985 | Shirai | 439/843 |
| 4,621,887 | 11/1986 | Piscitelli et al. . | |
| 4,717,356 | 1/1988 | Rahrig et al. . | |
| 4,780,097 | 10/1988 | Piscitelli . | |
| 4,950,183 | 8/1990 | Watanabe et al. | 439/843 |
| 5,158,485 | 10/1992 | Saito et al. | 439/843 |
| 5,226,842 | 7/1993 | Endo et al. | 439/843 |
| 5,259,796 | 11/1993 | Yamada et al. | 439/843 |
| 5,269,712 | 12/1993 | Denlinger et al. | 439/849 |
| 5,271,741 | 12/1993 | Saito et al. | 439/843 |
| 5,427,553 | 6/1995 | Tsuji | 439/851 |

FOREIGN PATENT DOCUMENTS

| | | |
|---|---|---|
| 1640146 | 3/1972 | Germany . |
| 62-243265 | 10/1987 | Japan . |
| 330361 | 3/1991 | Japan . |

*Primary Examiner*—David L. Pirlot

*Attorney, Agent, or Firm*—Sughrue, Mion, Zinn, Macpeak & Seas

[57] ABSTRACT

A terminal fabricated through the steps of forming a thin plate portion X with a part of the periphery left aside at the leading end of a female electric contact portion, providing a turnback thin plate X2 which is folded inside via an arcuate folded portion X1 in the thin plate portion X, and positioning the arcuate folded portion of a turnback contact piece in the part thereof.

11 Claims, 5 Drawing Sheets

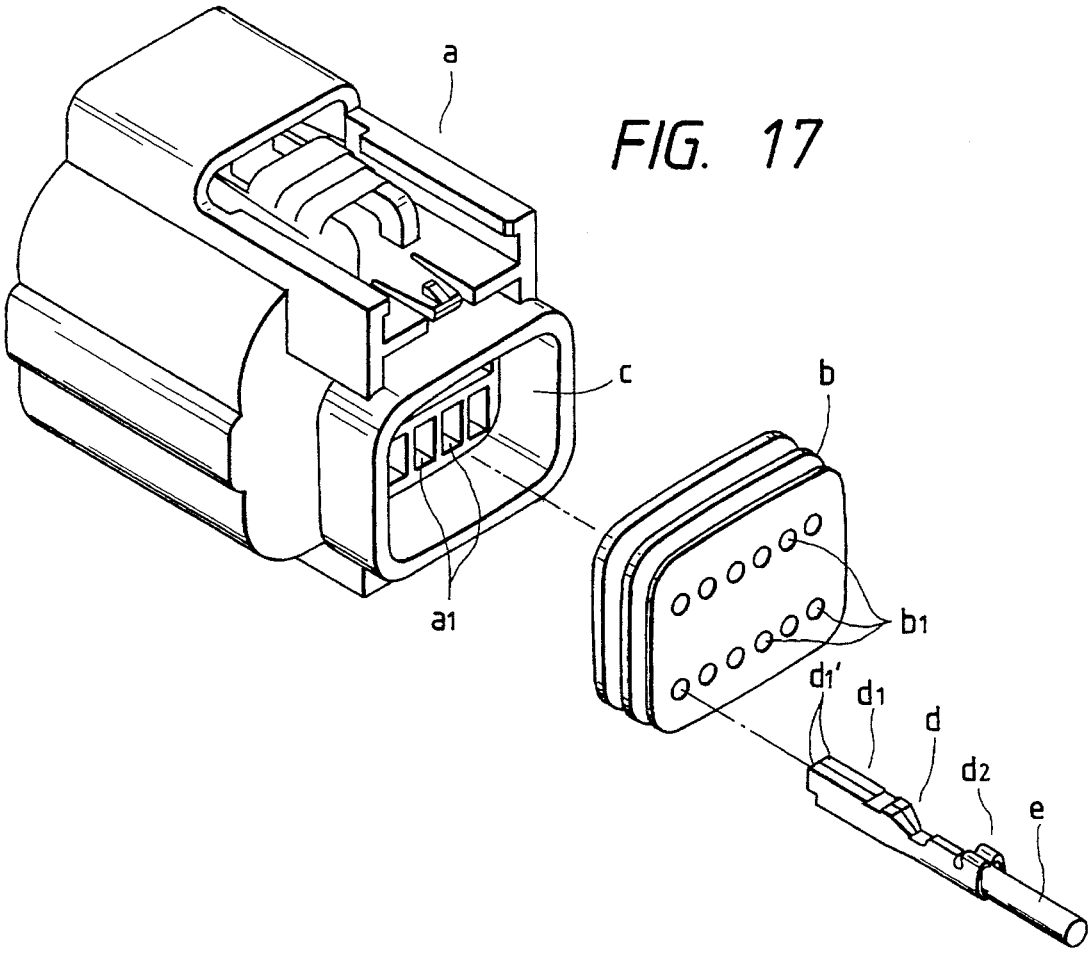
FIG. 17
FIG. 18
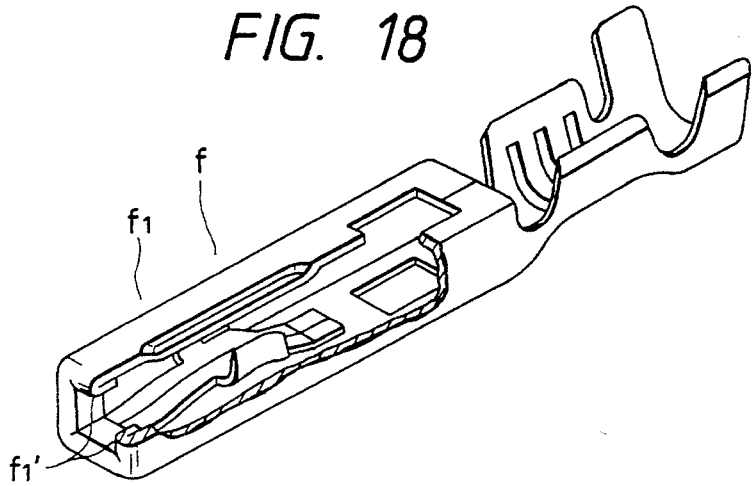

ELECTRIC TERMINAL

BACKGROUND OF THE INVENTION

1. Field of invention

The present invention relates to a connector terminal for use in connecting, for example, automobile wire harness, wherein connector inserting performance with respect to a connector housing is made improvable by eliminating a sharp edge portion at the leading end of the fitting.

2. Related art

FIG. 17 illustrates a waterproof connector such that in the rear end portion of a connector housing A there is formed a chamber c into which a waterproof tap b is fitted. The waterproof tap b in the form of a mat has round through-holes b1 corresponding to respective terminal receiving chambers a1 in the connector housing a.

In FIG. 17, reference character d represents a female terminal and an electric wire e has been connected to its wire joint d2. A female electric contact portion d1 is inserted through the corresponding sealing through-hole b1 into the destination terminal receiving chamber a1 and firmly retained therein by a known flexible retainer (not shown) so as to prevent the contact portion from slipping therefrom.

In this case, the presence of a sharp edge portion d1' at the leading end of the female electric contact portion d1 results in increasing the resistance of the female electric contact portion d1 against the sealing through-hole b1 when it is inserted therethrough, thus making the inserting work difficult.

FIG. 18 illustrates a female terminal of the sort disclosed in U.S. Pat. No. 4,717,356, wherein a turnback portion f1' folded inside is provided around the leading end of a female electric contact portion f1 so that a sharp edge portion can be dispensed with. However, the disadvantage in this case is that the terminal tends to become large-sized in proportion to the thickness of the turnback portion f1'.

SUMMARY OF THE INVENTION

In view of the foregoing problems, an object of the present invention is to set a female electric contact portion free from a sharp edge without making a terminal large-sized.

in order to accomplish the object above, a terminal according to the present invention is fabricated through the steps of forming a thin plate portion with a part of the periphery left aside at the leading end of a female electric contact portion, providing a turnback thin plate which is folded inside via an arcuate folded portion in the thin plate portion, and positioning the arcuate folded portion of a turnback contact piece in the part thereof.

Further, a terminal is fabricated through the steps of fitting a cap formed with a plate member thinner than a female electric contact portion over the leading end of the female electric contact portion in such a state that the cap and the female electric contact portion are coplanar, and providing a turnback thin plate which is folded inside via an arcuate folded portion around the leading end of the cap.

The arcuate folded portion situated at the leading end of the female electric contact portion functions as what eases the resistance of the terminal when it is inserted.

BRIEF DESCRIPTION OF THE DRAWINGS

FIG. 17 is a perspective view of a conventional example; and

FIG. 18 is a perspective view of another conventional example.

DETAILED DESCRIPTION OF THE PREFERRED EMBODIMENTS

Figure 1:
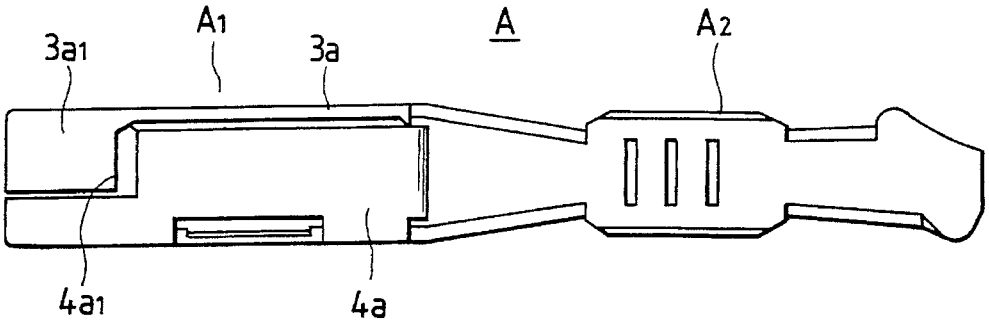
FIG. 1 is a top view of a terminal of an embodiment of the present invention.
Figure 2:
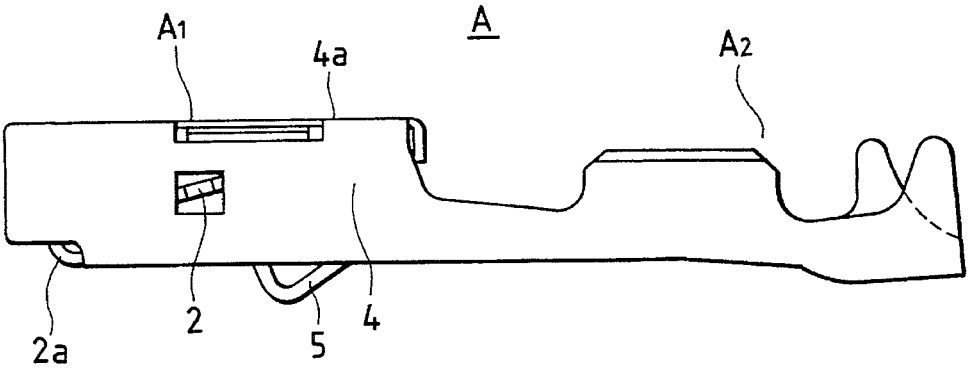
FIG. 2 is a side view of the terminal of FIG. 1.
Figure 3:
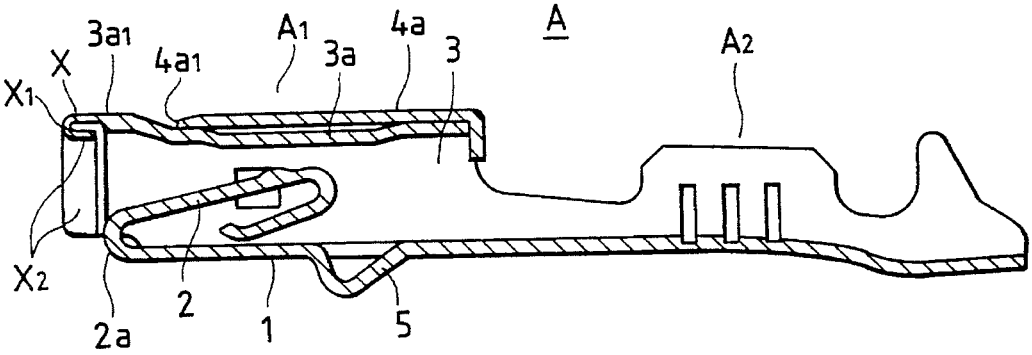
FIG. 3 is a vertical sectional view of the central part of FIG. 1.
Figure 4:
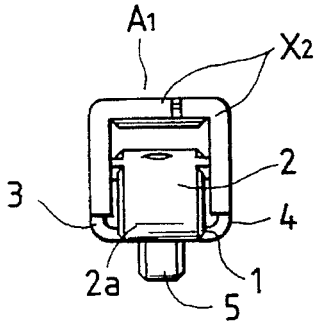
FIG. 4 is an elevational view of the terminal of FIG. 1.

Referring to FIGS. 1 through 4 inclusive, a female terminal A is integrally fabricated by machining one conductive metal sheet, and provided with a female electric contact portion A1 and an electric wire connecting portion A2.

A turnback elastic contact plate 2 is provided via an arcuate folded portion 2*a* at the leading end of the base 1 of the female electric contact portion A1 and both side plates 3, 4 are set upright. Further, top plates 3*a*, 4*a* folded inside are continuously coupled to the respective side plates 3, 4, the top plate 4*a* being superimposed on the top plate 3*a*.

A cutout 4*a*1 which is open to the forward side and to the side plate 3 is made at the leading end of the top plate 4*a*, whereas a swollen plate 3*a*1 situated within the cutout 4*a*1 is formed at the leading end of the top plate 3*a*, the sw plate 3*a*1 and the top plate 4*a* being coplanar.

Both side plates 3, 4, the top plate 4*a* and the swollen plate 3*a*1 of the top plate 3*a* project forward from the leading end of the base 1, that is, from the arcuate folded portion 2*a*. A thin plate X about ½ thick is formed in the projecting portion and a turnback thin plate X2 which is folded inside is provided via an arcuate folded portion X1 within the range of the thin plate X. In this case, reference numeral 5 denotes a mating protrusion standing out of the base 1.

A series of those ranging from the thin plate X up to the turnback thin plate X2 is formed beforehand in the stage of plate material during the process of manufacturing the terminal A and the plate material is then folded.

The arcuate folded portion X1 using the turnback thin plate X is formed in the most part of the surrounding leading end of the terminal A and the arcuate elastic folded portion 2*a* using the turnback elastic contact plate 2 is formed further at the leading end of the base, so that with the arrangement above the terminal A is readily inserted into a sealing through-hole of a waterproof tap.

Figure 5:
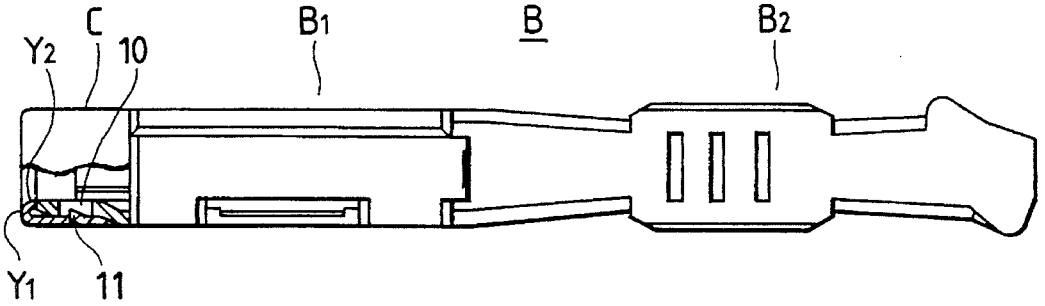
FIG. 5 is a partial exploded top view of another embodiment of the present invention.
Figure 6:
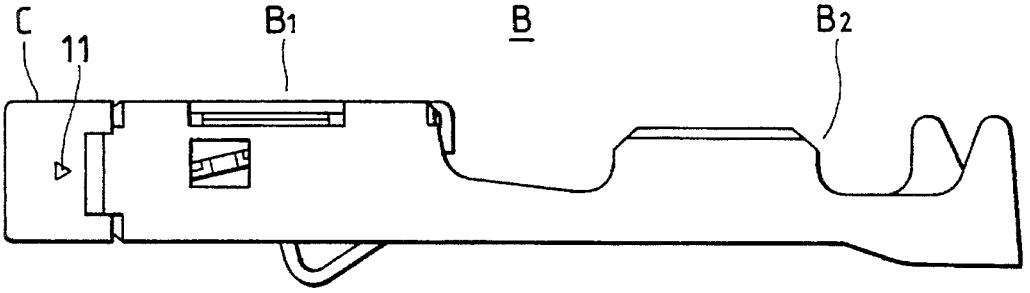
FIG. 6 is a side view of the structure of FIG. 5.
Figure 7:
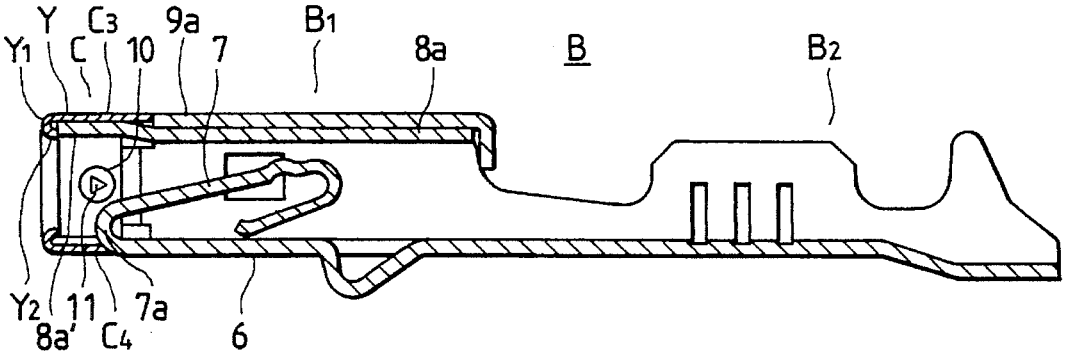
FIG. 7 is a vertical sectional view of the central part of FIG. 5.
Figure 8:
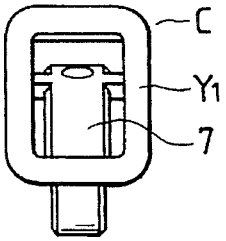
FIG. 8 is an elevational view of the structure of FIG. 5.

Referring to FIGS. 5 through 8 inclusive, there is shown therein another structure embodying the present invention, wherein a female terminal B has a female electric contact portion B1 and an electric wire connecting portion B2, a cap C free from a sharp edge fitting over the outer periphery of the leading end of the female electric contact portion B1.

Figure 9:
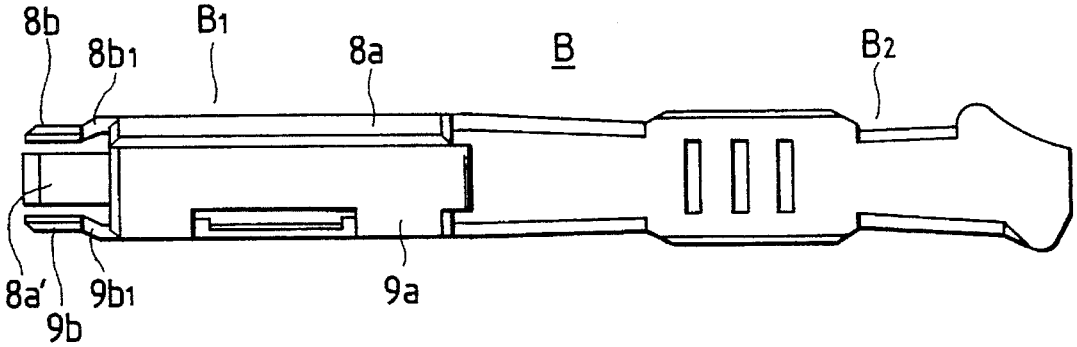
FIG. 9 is a top view of the female terminal of FIG. 5.
Figure 10:
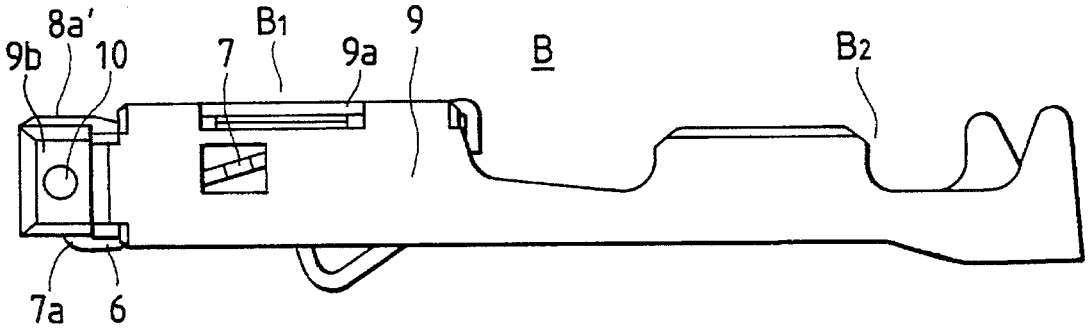
FIG. 10 is a side view of the female terminal of FIG. 5.
Figure 11:
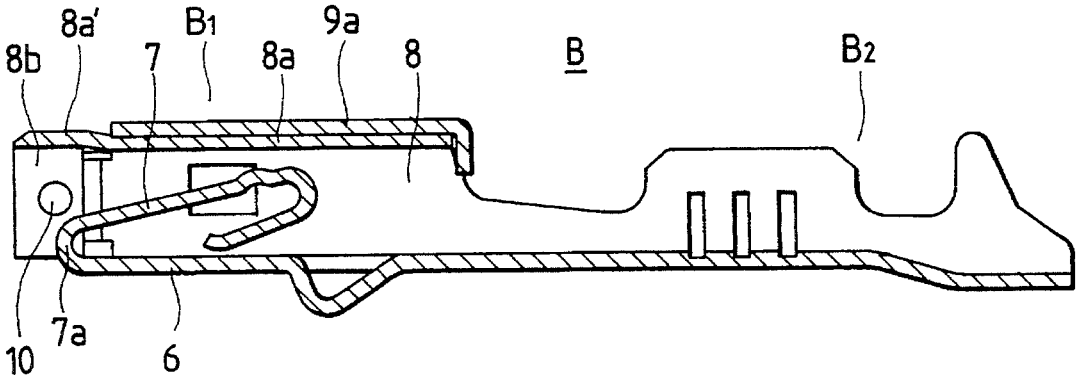
FIG. 11 is a vertical sectional view of the central part of FIG. 9.
Figure 12:
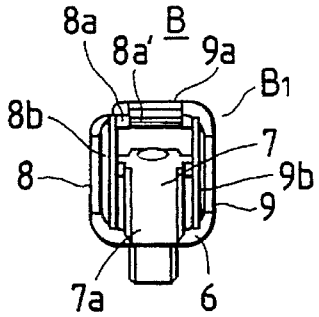
FIG. 12 is an elevational view of the structure of FIG. 9.

As shown in FIGS. 9 through 12 inclusive, a turnback elastic contact plate 7 is provided via an arcuate folded portion 7*a* at the leading end of the base 6 of the female electric contact portion B1 and both side plates 8, 9 are set upright. Further, top plates 8*a*, 9*a* folded inside are continuously coupled to the respective side plates 8, 9, and the top plate 9*a* is superimposed on the top plate 8*a*. An upper backing plate 8*a'* fitting to the inner top plate 8*a* projects forward from the top plate 9*a* and simultaneously exhibits slightly outwardly diverging displacement. Side backing plates 8*b*, 9*b* which is fitted via stepped portions 8*b*1 , 9*b*1 to the respective side plates 8, 9 project forward likewise and exhibit slightly inwardly contracting displacement. In addition, mating holes 10 are formed in the corresponding positions of the side backing plates 8*b*, 9*b*.

Figure 13:
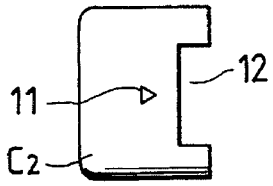
FIG. 13 a side view of a cap of the present invention.
Figure 14:
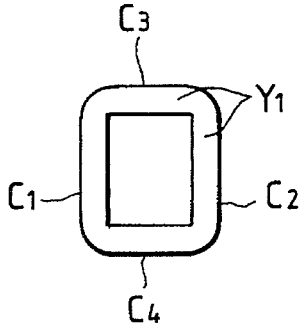
FIG. 14 is an elevational view of the cap of the present invention.
Figure 15:
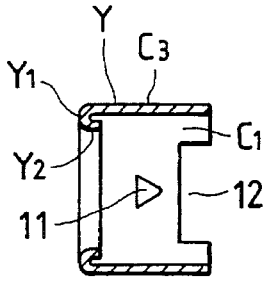
FIG. 15 is vertical sectional view of the cap of FIG. 14.
Figure 16:
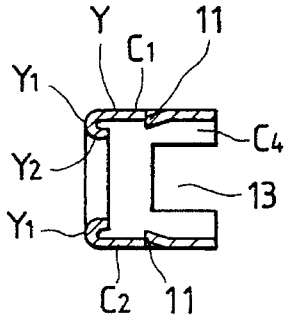
FIG. 16 is a transverse sectional view of the cap of FIG. 14

FIGS. 13 through 16 inclusive, illustrate the cap C, which is in the form of a square tube having side walls C1, C2, an upper wall C3 and a lower wall C4 corresponding to the female electric contact portion B1. Retaining projections 11 inwardly erected from the respective side walls C1, C2 corresponding to the side backing plates 8*b*, 9*b* are formed in such a way that they fit into the mating holes 10. Small cutouts 12 are formed in the rear of the side walls C1, C2, whereas a large cutout 13 is formed in the lower wall C4. The retaining projection 11 is formed so that its separating apex has a greater obtuse angle to increase its mating performance with the mating hole 10.

The cap C is formed with a thin plate Y which is ½ the thickness of the female terminal B and a turnback thin plate Y2 which is folded inside is provided around the leading end of the cap C via an arcuate folded portion Y1.

With the arrangement above, the cap C is secured by fitting it over the upper backing plate 8*a'* and the side backing plates 8*b*, 9*b* at the leading end of the female electric contact portion B1, and fitting the retaining projections 11 into the respective mating holes 10. In such a state that the leading end of the female electric contact portion B1 has completely been fitted into the cap C, the rear ends of the side walls C1, C2 of the cap C abut against the stepped portions 8*b*1, 9*b*1 of the side backing plates 8*b*, 9*b*, respectively. Further, the rear end of the small cutout 12 of the upper wall C3 abuts against the leading end of the top plate 9*a*, whereas the rear end of the large cutout 13 of the lower wall C4 abuts against the leading end of the base 6. In this manner, the combination of the side walls C1, C2 and both side plates 8, 9, that of the upper wall C3 and the top plate 9*a*, and that of the lower wall C4 and the base 6 are adjusted to coplanarity, respectively (see FIGS. 5, 6 and 7).

With the arrangement above, the arcuate folded portion Y1 is formed by cap C around the leading end of the terminal B.

In this case, any plastic material may be used for injection-molding the cap C.

According to the present invention, the arcuate folded portion of the turnback thin plate provided at the leading end of the female electric contact portion and the arcuate folded portion of the turnback elastic contact piece contribute to improving the inserting performance of the female terminal without making the fitting large-sized.

According to the present invention, the cap provided at the leading end of the female electric contact portion contributes to improving the inserting performance of the female terminal without making the fitting large-sized and also reinforcing the female electric contact portion with the effect of preventing it from deforming because of the external force applied thereto.

According to the present invention, any movement in a direction intersecting the axial direction of the cap can be prevented.

According to the present invention, the cap is prevented from moving in its axial direction.

What is claimed is:

1. A terminal comprising:

an electric wire connecting portion for connecting a wire;

an electric contact portion including:

a turnback elastic contact plate provided at a distal end of a base plate of the electric contact portion;

a pair of side plates upwardly extending from the base plate;

a pair of top plates bending inside, which are continuously coupled to the side plate, respectively, one top plate being superimposed on the other top plate;

at least one swollen portion provided on at least one of the side plate and the one top plate, wherein the swollen portion includes a backing plate extending outwardly from the one top plate, and side backing plates extending inwardly from the side plates, respectively, and wherein the side backing plates include engagement holes, respectively; and a cap in the form of a square tube, the cap having a pair of side walls, an upper wall and a lower wall, the side walls having projections, respectively, corresponding to the engaging holes, the lower wall having a large cutout portion, the upper wall having a small cutout portion.

2. A terminal as claimed in claim 1, wherein surfaces of the side walls, upper wall and the lower wall are flush with surfaces of the side plates, the other top plate and the base plate, respectively.

3. A terminal, comprising:

an electric wire connecting portion for connecting a wire thereto; and an electric contact portion for mating with another terminal, said electric contact portion including:

a base plate, a pair of side plates extending upwardly from said base plate, and a pair of top plates which respectively extend from said pair of side plates and which at least partially overlap one another such that one of said top plates is below the other of said top plates, said base plate, said side plates and said top plates combining to define a terminal receiving chamber therein with an opening at a forward-most end thereof, wherein said base plate includes an elastic contact portion extending into said chamber in a rearward direction thereof for resiliently engaging said another terminal, wherein said one top plate is bent upwardly in an area in which said top plates are not overlapped so as to be substantially flush with said other top plate and wherein a forward portion of said one top plate is bent in a U-shape to provide a curved portion which partially defines said opening to facilitate a smooth insertion of said another terminal, wherein the thickness of said forward portion of said one top plate is less than the thickness of the remaining portion of said one top plate.

4. The terminal of claim 3, wherein the thickness of said forward portion of said one top plate is one-half the thickness of the remaining portion of said one top plate.

5. A terminal, comprising:

an electric wire connecting portion for connecting a wire thereto; and an electric contact portion for mating with another terminal, said electric contact portion including:

a base plate, a pair of side plates extending upwardly from said base plate, and a pair of top plates which respectively extend from said pair of side plates and which at least partially overlap one another such that one of said top plates is below the other of said top plates, said base plate, said side plates and said top plates combining to define a terminal receiving chamber therein with an opening at a forward-most end thereof, wherein said base plate includes an elastic contact portion extending into said chamber in a rearward direction thereof for resiliently engaging said another terminal, wherein a forward portion of said one top plate is bent in a U-shape to provide a curved portion which partially defines said opening to facilitate a smooth insertion of said another terminal, wherein the thickness of said forward portion of said one top plate is less than the thickness of the remaining portion of said one top plate.

6. The terminal of claim 5, wherein the thickness of said forward portion of said one top plate is one-half the thickness of the remaining portion of said one top plate.

7. A terminal, comprising:

an electric wire connecting portion for connecting a wire thereto;

an electric contact portion for mating with another terminal, said electric contact portion including:

a base plate, a pair of side plates extending upwardly from said base plate, and a pair of top plates which respectively extend from said pair of side plates and which at least partially overlap one another such that one of said top plates is below the other of said top plates, said base plate, said side plates and said top plates combining to define a terminal receiving chamber therein with an opening at a forward-most end thereof; and a cap for covering said opening, said cap having a through-hole through which said another terminal is insertable, edges of said cap defining said through-hole being curved to facilitate insertion of said another terminal.

8. The terminal of claim 7, further comprising attaching means for attaching said cap to said electric contact portion.

9. The terminal of claim 8, wherein said attaching means includes projections extending from said cap which are engageable with openings in said side plates.

10. The terminal of claim 7, wherein the thickness of said cap is less that the thickness of said side plates and said top plates.

11. The terminal of claim 10, wherein the thickness of said cap is one-half the thickness of said side plates and said top plates.

* * * * *